United States Patent [19]

Makhlouf et al.

[11] Patent Number: 4,652,277

[45] Date of Patent: Mar. 24, 1987

[54] COMPOSITION AND METHOD FOR FORMING AN ABRASIVE ARTICLE

[75] Inventors: Makhlouf M. Makhlouf, Framingham; Thomas R. Schuster, Grafton, both of Mass.

[73] Assignee: Dresser Industries, Inc., Dallas, Tex.

[21] Appl. No.: 856,451

[22] Filed: Apr. 25, 1986

[51] Int. Cl.[4] ..... B24D 3/22

[52] U.S. Cl. ..... 51/309; 51/293

[58] Field of Search ..... 51/293, 308, 309

[56] References Cited

U.S. PATENT DOCUMENTS

| | | | |
|---|---|---|---|
| 3,528,789 | 9/1970 | Mathewson et al. . | |
| 3,554,717 | 1/1971 | Shaffer et al. . | |
| 3,576,610 | 4/1971 | Mathewson, Jr. . | |
| 3,743,489 | 7/1973 | Wentorf, Jr. et al. . | |
| 3,756,796 | 9/1973 | Miller | 51/293 |
| 3,852,049 | 12/1974 | Hibbs, Jr. et al. | 51/308 |
| 3,986,847 | 10/1976 | Balson | 51/308 |
| 4,035,161 | 7/1977 | Geissler et al. | 51/309 |
| 4,215,999 | 8/1980 | Phaal | 51/309 |
| 4,369,046 | 1/1983 | Bruscher et al. | 51/293 |
| 4,385,907 | 5/1983 | Tomita et al. . | |
| 4,490,158 | 12/1984 | Kuromatsu | 51/309 |
| 4,504,284 | 3/1985 | Ohno | 51/293 |
| 4,561,810 | 12/1985 | Ohno | 51/309 |

OTHER PUBLICATIONS

"Hob Sharpening with Superabrasives," S. Brickett, B. Lim and A. Schomann, Tooling and Production Magazine, Feb. 1982.

"Note on Thermal Expansion and Microstresses in Two-Phase Compositions," W. D. Kingery, Journal of the American Ceramic Society—Williams, Farncomb & Magliocca, vol. 40, No. 10, pp. 351-352 (1957).

"Vitrified Bonds-No Longer a Synonym for Conventional Abrasive Tools," Brian A. Cooley and Horst O. Juchem, Proceedings Super Abrasives 85 Symposium, Chicago, Ill. (1985).

*Primary Examiner*—Paul Lieberman

*Assistant Examiner*—Willie J. Thompson

[57] ABSTRACT

In accordance with the present invention, a composition of matter is provided for forming a vitrified abrasive wheel having an inner core and outer rim of differing compositions wherein said outer rim contains cubic boron nitride. The composition for the preferred rim material is a mixture comprising between about 10 to 70% by weight cubic boron nitride, between about 5 to 60% alumina, and about 15 to 35% bonding medium; and the preferred core composition comprises between about 10 to 65% silicon carbide, 10 to 60% alumina, and 5 to 30% bonding medium. In another aspect, a bonding medium is provided which is compatible with cubic boron nitride and in one embodiment has an oxide composition comprising about 71% silicon dioxide, 14% by weight boron oxide, about 5% by weight aluminum oxide, and about 10% by weight sodium oxide.

12 Claims, No Drawings

COMPOSITION AND METHOD FOR FORMING AN ABRASIVE ARTICLE

TECHNICAL FIELD

This invention relates to the manufacture of abrasive articles. More particularly, this invention relates to the manufacture of a vitrified abrasive wheel having an inner core and outer rim of differing compositions, wherein said outer rim contains cubic boron nitride and said rim and core have substantially equal coefficients of thermal expansion eliminating internal stresses between said rim and core.

BACKGROUND ART

This invention relates to the fabrication of a vitreous bonded cubic boron nitride abrasive article wherein said article's core comprises silicon carbide and alumina and said article's rim comprises cubic boron nitride and alumina, said core and rim having substantially equal coefficients of thermal expansion to avoid generation of internal stresses at the boundary between said rim and core during the article's cooling after being vitrified at temperatures up to about 1900° F.

It is well known in the art to use cubic boron nitride as an abrasive in grinding wheels. The cubic boron nitride preferred in the art has a zinc blend cubic structure with a resulting hardness approaching that of diamond and is described in U.S. Pat. No. 2,947,617 issued Aug. 2, 1960 to Wentorf. Cubic boron nitride in the form of an abrasive grain referred to as "borazon," is manufactured by the General Electric Co. and is relatively expensive. Notwithstanding its high cost, cubic boron nitride has been found to be useful in the grinding of metals and other hard materials. Thus, cubic boron nitride has been incorporated into metal bonded, organic resin bonded, and vitreous bonded grinding wheels.

In the grinding of metals and other hard materials, such as metal carbides, it is highly important that the grinding wheel be strong, resist thermal shock, resist mechanical shock, exhibit low wear, retain its shape, resist being loaded up by the material being ground (be free cutting), have good grinding efficiency and exhibit good metal removal rates. All of these attributes are of particular importance in a grinding operation such as the internal grinding of metal parts. It is, for example, particularly important that an internal grinding operation, such as the grinding of a bore in a metal part, that the grinding wheel maintain its shape and original dimensions for extended periods while exhibiting good strength, good grinding efficiency, and good metal removal rate. Excessive or uneven wear of the grinding wheel causes out of tolerance dimensions and undesirable alteration of the shape of the work piece.

These requirements also exist in the contour grinding of metals with preshaped grinding wheels, which requires that the wheel retain its initial shape and dimensions for long periods while having good grinding efficiency and metal removal rate. Similarly, these desirable attributes apply to all types of grinding to varying degrees. For instance, critical retention of grinding wheel shape is not as important as in other types of grinding, however, all grinding wheels must exhibit attributes which render them efficient and economical in use.

The coefficient of thermal expansion for preshaped grinding wheels used in either interior grinding operations or contour grinding operations must be known so that the grinding article can be intentionally undersized in a cold state, and thereby expand to the appropriate predetermined size from heat generated during use. Generally, the coefficient of thermal expansion for a grinding wheel consisting of several intimately mixed phases is related to the coefficient of expansion, weight fraction, bulk modulus, and density of each phase. The theoretical relation between these criteria and the average coefficient of thermal expansion is set forth in P. S. Turner, "Thermal Expansion Stresses in Reinforced Plastics," J. Research Natl Bur. Standards, 37[4]239–50 (1946); RP 1745.

One method in the prior art to incorporate bonded cubic boron nitride in a grinding wheel is to use an organic resin. However, these wheels are unsatisfactory in strenuous, high precision grinding operations, such as internal or contour grinding, because they readily lose their shape and have poor resistance to the high temperatures often encountered under strenuous grinding conditions. Examples of resin bonded cubic boron nitride grinding articles are described in U.S. Pat. No. 3,576,610 issued Apr. 27, 1971 to Mathewson.

Likewise, metal bonded cubic boron nitride grinding wheels have been fabricated, but are expensive, and consequently, their use has been confined principally to grinding very hard materials such as metal carbide cutting tool elements. Further, metal bonded cubic boron nitride wheels have a high coefficient of thermal expansion, and thus, their size and dimensions tend to change during use at varying loads. Metal bonded wheels also have the undesirable quality of loading up with the material being ground, and generally exhibit poor cutting rates. Examples of metal bonded cubic boron nitride articles are disclosed in U.S. Pat. No. 3,852,049 issued Dec. 3, 1974 to Hibbs, et al., which teaches the fabrication of a vitreous nitride product having a metal filler.

In the past, vitreous bonded cubic boron nitride grinding wheels have had limited success in commercial metal grinding operations, demonstrating superior usefulness where the grinding wheel is subjected to high mechanical and thermal shock, and is required to maintain its shape and dimensions over extended periods under strenuous grinding conditions. Typically, these articles are formed by cold pressing a mixture of cubic boron nitride, silicon carbide, and bonding medium to form the desired article, and then vitrifying said article at elevated temperatures up to about 1800° F. to form the final product. The bonding medium is chosen to have a coefficient of thermal expansion substantially identical with the cubic boron nitride component to facilitate formation of the vitrified product. However, bond failure with a loss of the cubic boron nitride abrasive grain is the principal cause for the poor performance of vitreous bonded wheels under high thermal and mechanical shock grinding conditions. Additionally, vitreous bonded cubic boron nitride grinding wheels exhibit low grinding efficiency for many types of metal and often require relatively high grinding pressure or force to achieve grinding action thereby aggrevating the problems associated with bond failure.

Examples of compositions and methods for producing vitreous bonded cubic boron nitride abrasive articles are disclosed in U.S. Pat. No. 3,986,847, issued Oct. 19, 1976 to Balson, teaching a method for producing a vitreous bonded grinding wheel having a substantially uniform distribution of cubic boron nitride throughout the article. While fabricated from expensive materials, Balson's wheel is free grinding, can grind at low grinding pressures, has good adhesion between the bond material and the cubic boron nitride so as to resist rapid or premature breaking out of the cubic boron nitride grain with subsequent rapid wear of the wheel and loss of its shape, is resistant to mechanical and thermal shock, and has good grinding efficiency.

In light of the relatively high expense of cubic boron nitride attempts have been made in the prior art to concentrate boron nitride in a wheel's grinding surface or rim. For instance, attempts have been made to attach cubic boron nitride material to the outer surface of a grinding wheel with an epoxy. This method has been less than satisfactory because of poor adhesion at high grinding pressures and the resulting high temperatures generated during use. Examples of these methods are disclosed in U.S. Pat. No. 4,385,907 issued May 31, 1983 to Tomita, et al.

Similarly, attempts have been made to form vitreous grinding articles with a higher concentration of cubic boron nitride at the article's grinding surface than in its core. Attempts to fabricate such articles have been unsuccessful in light of the substantially different coefficients of thermal expansion of cubic boron nitride and other materials used in the article's cores, such as silicon carbide, alumina, quartz, and other bonding mediums. Because of differing coefficients of thermal expansion the rim and core sections of these vitreous articles typically separate during the cooling phase of production, or if separation is not pronounced, have high internal stresses generated at the interface between the rim and core components so that separation or cracking results during use.

Consequently, a need exists for an efficient grinding wheel having a core made of less expensive materials and a continuous rim of vitreous bonded cubic boron nitride. A need also exists for cost effective grinding article having differing rim and core compositions which is not subject to separation or stresses at the interface between the rim and core. Further, a need exists for a cost effective wheel utilizing inexpensive material for its core, while providing all of the advantages of vitreous cubic boron nitride grinding articles such as resistance to mechanical and thermal shock, ability to be free grinding, and good metal removal rates.

Yet a further need exists for a cold pressed product incorporating a rim and core as one body with subsequent firing providing a complete vitreous bonded body composed of two separate compositions. A further need exists for a vitreous glassy bonding medium that is compatible with cubic boron nitride to avoid rapid or premature breaking out of the boron nitride grain, and similarly compatible with a lower cost core composition to provide a totally integrated vitreous bonded article.

DISCLOSURE OF THE INVENTION

In accordance with the present invention, a composition and method are provided for forming a super abrasive grinding article having a continuous rim of vitreous bonded cubic boron nitride around the periphery of the article's core, said core being made of an inexpensive abrasive material. In particular, a composition and method are provided for forming super abrasive grinding wheels having a continuous rim of vitreous bonded cubic boron nitride around a core of inexpensive vitreous bonded silicon carbide wherein said rim and core are cold pressed as one body and fired to provide a vitreous bonded body composed of two separate compositions. Further, the present invention provides a composition and method for producing a vitreous glassy bonding medium that is compatible with cubic boron nitride and silicon carbide to provide a totally integrated vitreous bonded wheel that resists the breaking out of the cubic boron nitride grain during use, and to provide resistance to mechanical shock superior to that of the vitreous articles of the prior art.

Broadly stated, the composition for forming a cubic boron nitride rim on a silicon carbide core suitable for use in this invention comprises from between about 10 to 70% by weight cubic boron nitride, from about 5% to 60% by weight alumina, and from between about 15 to 35% by weight bonding medium. The composition for forming cores useful in the present invention comprises from between about 10 to 65% by weight silicon carbide, from about 10 to 60% by weight alumina, and from about 5 to 30% by weight bonding medium.

In another aspect, the present invention provides a composition and method for forming a bonding medium which is compatible with, and can be used in, both the cubic boron nitride rim and silicon carbide core. In one embodiment, the composition of the vitreous bond of the present invention has an oxide formulation comprising about 71% by weight silicon dioxide, about 14% by weight boron oxide, about 5% by weight aluminum oxide, and about 10% by weight sodium oxide. However, it will be understood that other bonding medium compositions may be employed. In alternative embodiments, the vitreous bond can also contain lithium oxide, magnesium oxide, calcium oxide, potassium oxide, barium oxide, zinc oxide, or beryllium oxide, for example. Said bonding medium can also include a binding material to permit grinding articles to be cold pressed to form solid "green" prefired articles that can be handled before vitrification without being damaged.

In accordance with the method of the present invention, the rim portion is prepared by admixing a uniform mixture of cubic boron nitride and alumina with water and then combining the admixture with dry bonding medium to form a moist homogenuous granular mixture. Likewise, the core portion is prepared by admixing a uniform mixture of silicon carbide and alumina with water and then combining the admixture with dry bonding medium to form a moist homogenuous granular mixture. The nitride-alumina and carbide-alumina mixtures are placed in a suitable mold with the nitride-alumina component located so as to form the grinding surface of the article and are cold pressed into the form of the desired grinding article. Said article is then dried for a period of about 12 to 24 hours at a temperature of 150° F., vitrified at elevated temperatures from between about 1600° F. and about 1900° F., and cleaned and inspected to form the superabrasive article of the present invention.

DETAILED DESCRIPTION

In accordance with one aspect of the present invention, a composition is provided for forming an abrasive article having a complete vitreous bonded body composed of two separate compositions, wherein the grinding surface rim of said article is comprised of cubic boron nitride, alumina and vitrified bonding medium, and the core of said article is comprised of silicon carbide, alumina and vitrified bonding medium. The abrasive article formed in accordance with the present invention possesses all the advantages of a vitreous bonded cubic boron nitride article such as resistance to thermal shock, resistance to mechanical shock, low wear, retention of shape, resistance to being loaded up by the material being ground, high grinding efficiency, and a high metal removal rate, while being principally composed of low cost ingredients. Further, the vitreous article produced by the method of the present invention possesses strength and resistance to mechanical shock superior to those of the vitreous article of the prior art.

To form a complete vitreous bonded body composed of two separate compositions, the coefficient of thermal expansion for each composition must be substantially identical to avoid the generation of internal stresses, cracking, or separation during the article's cooling after vitrification. Generally, the average coefficient of thermal expansion for an article consisting of several intimately mixed phases is described by P. S. Turner in "Thermal Expansion Stresses in Reinforced Plastics," J. Research Natl. Bur. Standards, 37[4]239–50 (1946) as:

$$\alpha = \frac{\alpha_1 K_1 P_1/d_1 + \alpha_2 K_2 P_2/d_2 + \ldots}{P_1 K_1/d_1 + P_2 K_2/d_2 + \ldots} \quad (1)$$

where:

$\alpha$=the expansion coefficient of the phase
P=the weight fraction of the phase
K=bulk modulus of the phase
d=density of the phase.

And for ingredients with approximately the same value for Poisson's ratio, K can be replaced by the modulus of elasticity, E, giving:

$$\alpha = \frac{\alpha_1 P_1 E_1/d_1 + \alpha_2 P_2 E_2/d_2 + \ldots}{P_1 E_1/d_1 + P_2 E_2/d_2 + \ldots} \quad (2)$$

For cubic boron nitride:
$\alpha$(Per° C.)=$4.6\times10^{-6}$
d (lbs per cubic inch)=0.130
E (psi)=$98.6\times10^{6}$
For silicon carbide:
$\alpha$(Per ° C.)=$4.7\times10^{-6}$
d (lbs per cubic inch)=0.1213
E (psi)=$70\times10^{6}$
For aluminum oxide:
$\alpha$ (Per °C.)=$8.4\times10^{-6}$
d (lbs per cubic inch)=0.144
E (psi)=$52.5\times10^{6}$ In one embodiment of the present invention, the composition of the vitreous bond comprises an oxide formulations of about 71% by weight silicon dioxide, about 14% by weight boron oxide, about 5% by weight aluminum oxide, and about 10% by weight sodium oxide. However, it will be further understood that bonding mediums can also be formulated to result in an oxide formulation also containing calcium oxide, magnesium oxide, lithium oxide, potassium oxide, barium oxide, zinc oxide, or beryllium oxide, for example and that for a typical bonding medium:

$\alpha$ (Per °C.)=$6.1\times10^{-6}$
d (lbs per cubic inch)=0.0833
E (psi)=$11\times10^{6}$ It will be further understood that for cubic boron nitride, silicon carbide, aluminum oxide, and most bonding mediums poisson's ratio K is approximately equal to the modulus of elasticity E, allowing application of equation (2) to calculate $\alpha$.

The following table sets forth examples of the optimum composition for the core material calculated from Turner's relationship as the weight fraction of cubic boron nitride in the rim increases.

| Rim Composition | | | Calculated $\alpha$(rim) | Optimum Core Composition | | |
|---|---|---|---|---|---|---|
| CBN | Alumina | Bond | (Per °C.) | Si C | Alumina | Bond |
| 0.1913 | 0.5637 | 0.2450 | $6.8\times10^{-6}$ | 0.231 | 0.524 | 0.245 |
| 0.3900 | 0.3600 | 0.2500 | $5.8\times10^{-6}$ | 0.452 | 0.298 | 0.250 |
| 0.5964 | 0.1487 | 0.2550 | $5.1\times10^{-6}$ | 0.646 | 0.099 | 0.255 |

In accordance with the present invention, the composition of the green rim material comprises between about 10 to 70% by weight cubic boron nitride, between about 5 to 60% by weight alumina, and between about 15 to 35% by weight bonding medium. The composition of the green core material comprises from between about 10 to 65% by weight silicon carbide, between about 10 to 60% by weight alumina, and between about 5 to 30% by weight bonding medium. It will be understood that while the green rim and core compositions suffer various ignition losses during vitrification the composition of the vitrified product will be substantially identical to that of the green article, and consequently, Turner's relation is applied to the green rim and core compositions to determine the coefficient of thermal expansion for the vitrified rim and core materials.

The preferred green rim composition contains about 39% by weight cubic boron nitride, about 36% by weight alumina, and about 25% by weight bonding medium; and the preferred core composition comprises about 40% by weight silicon carbide, about 40% by weight alumina, and about 20% by weight bonding medium. This composition is preferred because of it's vitrified product's superior performance with most steels under most grinding conditions, however, it will be understood that for every grinding operation there may be a more optimum rim composition to yield superior results.

It will be further understood that while the weight percent vitreous bond in either the rim or core may vary between about 5 to 35%, the amount of bond in the rim composition is dictated by the grinding application and the type of metal for which the wheel is specifically designed. For example, some metals require a "hard acting wheel" having a relatively high weight percent of vitreous bond, while other metals require a "soft acting wheel" having a relatively lower weight percent of bond.

In utilizing the compositions in accordance with the present invention, the rim composition is formed by admixing particulate cubic boron nitride and particulate alumina with water to form a moist homogenous granular mixture. Generally, about 5 parts by weight water are admixed with about 75 parts by weight nitride—alumina mixture by hand use of a spatula, although a Glen mixer may be used. The bonding medium is dry mixed separately to form a uniform dry powder and said powder is blended with a binder. Generally, about 25 parts by weight dry bond medium are mixed with about 2 parts by weight binder. The preferred binder is sold under the trade name "Dextrin". The dry bond-binder blend is then admixed with the wet nitride-alumina mix by hand with care being taken to remove all lumps and other nonuniform particles. After a thorough mixing, the mixture is further mixed by passing it through a 60 mesh sieve several times in order to form a uniform mixture.

The composition of the core section is formed by mixing suitable amounts of silicon carbide and alumina with water to form a moist homogenuous granular mixture. Generally, about 25 parts by weight carbide-alumina mixture are mixed with about one part by weight water in a Glen mixer. Subsequently, a suitable amount of the bond-binder blend is added in a dry form to the wet carbide-alumina mixture and is mixed thoroughly to assure that no lumps or other nonuniform particles remain. The mixture is further mixed by passing it through a 60 mesh screen several times to form a uniform mixture.

It will be understood that the binder material is employed in both the rim and core compositions to allow these materials to be pressed into a green article that is resistant to damage prior to its vitrification. It will be further understood that to ensure easy and proper mixing of the components at least one part by weight water should be employed for about 10 parts by weight bonding medium in both the rim and core mixtures.

The required amounts of core material and rim material are placed in a suitable mold and pressed to form the unfinished article. Generally, the green article will have a core composition comprising from between about 10 to 65% silicon carbide, from between about 10 to 60% alumina, from between about 5 to 30% bonding medium, from between about 1 to 2% by weight binder, and from between about 3 to 5% by water; and a rim composition comprising from between about 10 to 70% by weight cubic boron nitride, from between about 5 to 60% alumina, from between about 15 to 35% bonding medium, from between about 1 to 2% by weight binder, and from between about 3 to 5% by weight water. The green article is dried for about 12 to 24 hours in a forced air dryer at about 150° F., is vitrified by firing at a predetermined rate to an elevated temperature between about 1600° F. and 1900° F., which temperature is maintained for a period of time to allow vitrification, and is then slowly cooled.

In accordance with the present invention, the unfinished abrasive article is vitrified by heating the article to a temperature of about 900° F. over a period of about eight hours, then raising the temperature to between about 1600° and about 1900° F. in about 25 hours, holding the temperature at between about 1600° to about 1900° F. for about 6 hours, then cooling the article to about 1400° F. in about 6 hours, then further cooling the article to about 1100° F. in about 10 hours, then cooling to a temperature of about 100° F. over 18 hours. However, it will be understood that different time temperature profiles may be used to obtain satisfactory vitrification of green articles, and that large articles require both slow heating and cooling rates to prevent thermal cracking, while smaller articles can be heated and cooled at faster rates without the danger of cracking.

Various advantages of the invention are apparent from the following examples and it will be understood that the following examples are presented to illustrate this invention and are not intended as any limitation thereof.

EXAMPLE 1

A grinding article having a rim composition of 39% by weight cubic boron nitride, 36% by weight alumina and 25% by weight vitrous bond is desired. By the relation described by Turner, the coefficient of thermal expansion for such a rim composition is calculated to be $5.8\times10^{-6}$ per °C. To form an abrasive article having a complete vitreous bonded body composed of two separate compositions, the core composition must have a coefficient of thermal expansion substantially equal to $5.8\times10^{-6}$ per °C. to avoid the generation of internal stresses, cracking, and/or separation of the rim and core at their interface during cooling after vitrification. Consequently, the coefficient of thermal expansion is set to be $5.8\times10^{-6}$ per °C. and using Turner's relationship the weight percents of silicon carbide, alumina and vitrous bond in the core are calculated to be 45.2%, 29.8% and 25% respectively.

EXAMPLE 2

A grinding article having a rim composition of 39% by weight cubic boron nitride, 36% by weight alumina and 25% by weight vitrous bond is desired. The desired bonding medium has an oxide composition of about 71% by weight silicon dioxide, about 14% by weight boron oxide, about 5% by weight aluminum oxide, and about 10% by weight sodium oxide, and a coeffecient of thermal expansion of $6.1\times10^{-6}$ per degree C. By the relation described by Turner, the coefficient of thermal expansion for the rim composition is calculated. The core formulation is desired to have substantially equal amounts of silicon carbide and alumina, and applying the desired coefficient of thermal expansion to Turner's relation the core composition is calculated to be about 42.1% by weight silicon carbide, about 42.1% by weight alumina, and about 15.8% by weight vitreous bond.

To form the rim portion of the desired article, the cubic boron nitride is thoroughly mixed in a dry state with the alumina. The boron nitride used is 170/200 grit ("Borozon 550") and the alumina is 180 grit. These materials are thoroughly admixed with water by hand with a pallet knife to form a paste. The bonding medium is mixed with dry Dextrin binder and the bond-binder powder is slowly added to the nitride-alumina paste with a pallet knife. The mixture is further mixed by passing it through a 60 mesh screen at least two times to form a uniform mixture comprised as follows:

| | |
|---|---|
| Cubic Boron Nitride | 36.43% by weight |
| Alumina | 33.66% by weight |
| Bonding medium | 23.36% by weight |
| Dextrin | 1.87% by weight |
| Water | 4.68% by weight |

The core portion of the desired abrasive article is formed by thoroughly mixing the silicon carbide with the alumina in a dry state. The silicon carbide and alumina used are both 220 grit. Water is then admixed with the carbide-alumina mixture to form a paste. These materials are thoroughly mixed in a Glen mixer at 80 rpm for about 3 minutes. The bonding medium is mixed with dry Dextrin binder and the bond-binder powder is slowly added to the silicon carbide-alumina paste in the Glen mixer. The mixer is set at about 20 rpm, the mixing performed slowly to assure that no lumps or other unmixed material remain. When the dry bond-binder mixture is completely delivered to the Glen mixer all ingredients are then mixed at about 30 rpm for about 4 minutes, with care being taken to scrape down the sides of the bowl to assure thorough mixing. The mix is then screened through a 60 mesh screen at least two times to ensure thorough mixing to form a uniform mixture comprised as follows:

| | |
|---|---|
| Green Silicon Carbide | 40.00% by weight |
| Alumina | 40.00% by weight |
| Bonding medium | 15.00% by weight |
| Dextrin | 1.50% by weight |
| Water | 3.50% by weight |

The rim and core mixtures are placed in a suitable mold located in a press with care being taken so that the rim mixture is located in the mold to form the outside surface of the desired grinding wheel, and are pressed to form a green wheel of the desired shape and size. The green wheel is set on a ceramic batt and placed in a drying oven overnight at about 150° F. After drying, the wheel is fired at a temperature of about 100° F., said temperature being raised to about 900° F. over a 8 hour period, raised to about 1750° F. in about 25 hours and held constant at about 1750° F. for about 6 hours, cooled to about 1400° F. in 6 hours cooled to about 1100° F. in 10 hours, and further cooled to 100° F. in about 18 hours. The vitrified wheel is hand reamed using an abrasive maul, trued under wet grinding conditions and inspected for cracks.

EXAMPLE 3

An abrasive article having a rim composition of 58% by weight cubic boron nitride, 14.5% by weight alumina and 27.5% by weight vitrous bond is desired. The bonding medium has an oxide composition of about 71% by weight silicon dioxide, about 14% by weight boron oxide about 5% by weight aluminum oxide, and about 10% by weight sodium oxide, and a coefficient of thermal expansion of $6.1\times10^{-6}$ per degree C. Using Turner's relation the coefficient of thermal expansion for the rim formulation is calculated and the resulting core formulation is about 63% by weight silicon carbide, about 21% by weight alumina, and about 16% by weight vitreous bond.

The green rim material is formed by mixing the appropriate amounts of cubic boron nitride, alumina, bonding medium, dextrin, and water in accordance with the procedure set forth in example 2 to yield the following composition:

| | |
|---|---|
| Cubic Boron Nitride | 53.94% by weight |
| Alumina | 13.45% by weight |
| Bonding medium | 25.63% by weight |
| Dextrin | 1.86% by weight |
| Water | 5.12% by weight |

The green core material is formed by mixing the appropriate amounts of green silicon carbide, alumina, bonding medium, dextrin, and water in accordance with the procedure in example 2 to form the following composition:

| | |
|---|---|
| Green Silicon Carbide | 60.00% by weight |
| Alumina | 20.00% by weight |
| Bonding medium | 15.00% by weight |

-continued

| | |
|---|---|
| Dextrin | 1.50% by weight |
| Water | 3.50% by weight |

The rim and core materials are placed in a mold located in a press and are pressed to form a green wheel as decribed in Example 2. The green wheel is fired, cooled, reamed, trued, and inspected in accordance with a procedure set forth in Example 2 to yield a vitrified grinding wheel.

EXAMPLE 4

A grinding article having a rim composition of 19% by weight cubic boron nitride, 56.5% by weight alumina and 24.5% by weight vitrous bond is desired. The bond medium has an oxide composition of about 71% by weight silicon dioxide, about 14% by weight boron oxide, about 5% by weight aluminum oxide, and about 10% by weight sodium oxide, and a coefficient of thermal expansion of $6.1\times10^{-6}$ per degree C. Using Turner's relation, the coefficient of thermal expansion of the rim composition is calculated and the core composition is determined to be about 23% by weight silicon carbide, about 52.5% by weight alumina, and about 24.5% vitreous bond.

The rim material is formed by mixing cubic boron nitride, alumina, vitreous bond, dextrin, and water in the appropriate amounts pursuant to the procedure set forth in Example 2 to yield the following composition:

| | |
|---|---|
| Cubic Boron Nitride | 17.88% by weight |
| Alumina | 52.72% by weight |
| Bonding medium | 22.93% by weight |
| Dextrin | 1.87% by weight |
| Water | 4.60% by weight |

The green core material is formed by mixing silicon carbide, alumina, vitreous bond, dextrin and water in the appropriate amounts as per the procedure set forth in Example 2, yielding the following composition:

| | |
|---|---|
| Silicon Carbide | 21.61% by weight |
| Alumina | 49.00% by weight |
| Bonding medium | 22.91% by weight |
| Dextrin | 1.87% by weight |
| Water | 4.61% by weight |

The rim and core compositions are placed in a suitable mold located in a press and pressed to form a green wheel. The green wheel is then fired, cooled, reamed, trued, and examined in accordance with the procedure set forth in Example 2 to yield a vitrified grinding wheel.

EXAMPLE 5

A grinding article having a rim composition of about 39% by weight cubic boron nitride, about 36% by weight alumina, and about 25% by weight vitreous bond is desired. A bonding medium is chosen to have an oxide composition of about 52.5% by weight silicon dioxide, about 36.3% by weight boron oxide, about 1.0% by weight aluminum oxide, about 2.9% by weight calcium oxide, and about 7.3% by weight sodium oxide, having a coefficient of thermal expansion of about $6.3\times10^{-6}$ per degree C. The corresponding core composition is 42.1% by weight silicon carbide, 42.1% by weight alumina, and 15.8% by weight vitreous bond as per Turner's relation.

The green rim material is formed by mixing appropriate amounts of cubic boron nitride, alumina, bonding medium, dextrin and water pursuant to the procedure set forth in Example 2. Likewise, the green core material is formed by mixing silicon carbide, alumina, bonding medium, dextrin and water pursuant to the procedure set forth in Example 2.

The green rim and core materials are placed in a suitable mold located in a press and pressed to form a green wheel. The green wheel is fired in accordance with the procedure set forth in Example 2 with the exception that the maximum firing temperature is 1600° F. as opposed to 1750° F. The resulting article is cooled, reamed, trued, and inspected to yield a vitrified grinding article having a rim composition of about 39% by weight cubic boron nitride, about 36% by weight alumina and about 25% by weight vitrous bond.

EXAMPLE 6

Five vitrified grinding wheels were fabricated in accordance with the composition and method set forth in Example 2, and five bars having dimensions of 0.234 inches by 0.5375 inches by 1.00 inch were cut from the cores of the wheels. The bars were broken in three point bending on an Instron Universal Testing Machine at a rate of 0.05 inches per minute. The braking loads and pounds were recorded and used to calculate the strength of each bar. Likewise, similar bars were cut from cores of a commercially available vitreous bonded cubic boron nitride grinding wheel and where broken, the breaking point load recorded and used to calculate the strength of the core of the commercially available material. The results of these tests are set forth below:

| Sample No. | Load (lbs) | Strength (psi) |
|---|---|---|
| VITRIFIED CORE OF THE PRESENT INVENTION | | |
| 1 | 379 | 8409 |
| 2 | 386 | 8565 |
| 3 | 379 | 8409 |
| 4 | 380 | 8431 |
| 5 | 380 | 8431 |
| VITRIFIED CORE OF THE PRIOR ART | | |
| 6 | 386 | 5279 |
| 7 | 368 | 5033 |
| 8 | 438 | 5990 |
| 9 | 432 | 5908 |
| 10 | 377 | 5156 |

In comparing the data reflected in the above table, it is seen that the average breaking strength of the vitrified core of the present material is 8449 pounds per square inch while the average breaking strength of the vitrified core material of the prior art is 5473 pounds per square inch, reflecting that the core material of the present invention is about 54% stronger than the core material of the prior art.

EXAMPLE 7

A vitreous bonded cubic boron nitride grinding wheel was made according to the composition and method set forth in Example 3, and was compared in grinding tests to a commercially available vitreous bonded cubic boron nitride grinding wheel in the surface grinding of M2 steel hardened to Rockwell C58 hardness. The test conditions were as follows:

| | |
|---|---|
| Wheel Size: | 6 × 0.25 × 1.25 inches |
| Work size: | 3 × 6 inches |
| Wheel speed: | 3600 r.p.m. |
| Table speed: | 50 ft per minute |
| Coolant: | a solution of 15% commercially available water soluble oil and 85% water |
| Downfeed: | 0.001 inch per pass |

The present invention's vitreous bonded cubic boron nitride grinding wheel's volumetric efficiency was 493, and the commercially available vitreous bonded cubic boron nitride grinding wheel's volumetric efficiency was about 72, where "volumetric efficiency" is the ratio of the amount of steel removed to the amount of grinding wheel removed.

EXAMPLE 8

A vitreous bonded cubic boron nitride grinding wheel is made in accordance to the composition and method set forth in Example 3, and was compared to a commercially available vitreous bonded cubic boron nitride grinding wheel in the surface grinding of T15 steel hardened to Rockwell C68 hardness. The wheel size and test conditions were the same as recited in Example 7.

The present invention's vitreous bonded cubic boron nitride grinding wheel's volumetric efficiency of 108, and the commercially available wheel's efficiency was about 50.

EXAMPLE 9

A vitreous bonded cubic boron nitride grinding wheel was made in accordance to the composition and method set forth in Example 5, and was compared to a commercially available vitreous bonded cubic boron nitride grinding wheel in the surface grinding of M2 steel hardened to Rockwell C58 hardness. The wheel size and test conditions were the same as set forth in Example 7.

The present inventions's vitreous bonded cubic boron nitride grinding wheel's volumetric efficiency was 178, and the commercially available wheel's volumetric efficiency was about 72.

EXAMPLE 10

A vitreous bonded cubic boron nitride grinding wheel was made in accordance to the composition and method of Example 5, and was compared to a commercially available vitreous bonded cubic boron nitride wheel in the surface grinding of T15 steel hardened to Rockwell C63 hardness. The wheel size and test conditions were the same as set forth in Example 7.

The present invention's vitreous bonded cubic boron nitride grinding wheel's volumetric efficiency was 63, and the commercially available grinding wheel's volumetric efficiency was about 50.

EXAMPLE 11

A vitreous bonded cubic boron nitride grinding wheel was made in accordance to the composition and method of Example 2, and was compared to commercially available conventional grinding wheels in the internal plunge grinding of gas turbine combustion housings. The following conditions were employed:

| | |
|---|---|
| Wheel size: | 6 × 0.75 × 1.00 inches |
| Work Size: | 12.00 inch inner diameter |
| Wheel Speed: | 8500 surface feet per minute |
| Coolant: | Commercially available water soluble oil |
| Metal Removal: | 0.350 inches |

The average grinding time was reduced from 5 hours for the conventional vitrified grinding wheel to 20 minutes for the vitrified cubic boron nitride grinding wheel of the present invention.

EXAMPLE 12

A vitrified bonded cubic boron nitride grinding wheel was made in accordance with the composition and method of Example 2, and compared to commercially available vitreous bonded cubic boron nitride grinding wheels in the internal bore grinding of M50 steel hardened to Rockwell C62 hardness. The following conditions were employed:

| | |
|---|---|
| Wheel Size: | 2.5 × 0.446 × 0.625 inches |
| Work Size: | 4.00 ID by 0.625 width inches |
| Wheel Speed: | 9500 surface feet per minutes |
| Coolant: | Commerically available water soluble oil |

The vitreous bonded cubic boron nitride grinding wheel of the present invention decreased the grinding cycle time from approximately 3.2 minutes to 2.75 minutes, produced a better surface finish and better size control with no heat generation.

While the present invention has been described with respect to preferred embodiments, it will be understood that the invention is capable of numerous rearrangements, modifications and alterations and such rearrangements, modifications and alterations are intended to be within the scope of the appended claims.

We claim:

1. A vitrified abrasive article having a core and rim, wherein said core and rim have substantially equal coefficients of thermal expansion, said core comprising a mixture of silicon carbide, alumina, and vitrified bonding medium; and said rim comprising a mixture of cubic boron nitride, alumina, and vitrified bonding medium.

2. A vitrified abrasive article having a core and rim, wherein said core and rim have substantially equal coefficients of thermal expansion, said core comprising:
(a) from between about 10 to 65% by weight silicon carbide;
(b) from between about 10 to 60% by weight alumina; and
(c) from between about 5 to 30% by weight vitrified bonding medium; and said rim comprising
(d) from between about 10 to 70% by weight cubic boron nitride;
(e) from between about 5 to 60% by weight alumina; and
(f) from between about 15 to 35% by weight vitrified bonding medium.

3. The vitrified abrasive article of claim 2, wherein said vitrified bonding medium comprises:
about 71% by weight silicon oxide;
about 14% by weight boron oxide;
about 5% by weight aluminum oxide; and
about 10% by weight sodium oxide.

4. The vitrified abrasive article of claim 2, wherein said vitrified bonding medium comprises:
about 53% by weight silicon oxide;
about 36% by weight boron oxide;
about 3% by weight calcium oxide;
about 1% by weight aluminum oxide; and
about 7% by weight sodium oxide.

5. A vitrified abrasive article having a core and rim, wherein said core and rim have substantially equal coefficients of thermal expansion, said core comprising:
(a) about 42% by weight silicon carbide;
(b) about 42% by weight alumina; and
(c) about 16% by weight vitrified bonding medium; and said rim comprising:
(d) about 39% by weight cubic boron nitride;
(e) about 36% by weight aluminum; and
(f) about 25% by weight vitrified bonding medium; wherein said vitrified bonding medium comprises:
about 71% by weight silicon dioxide;
about 14% by weight boron oxide;
about 5% by weight aluminum oxide; and
about 10% by weight sodium oxide.

6. A method of forming a vitrified abrasive article having a core and rim comprising the steps of:
(a) determining the weight percent cubic boron nitride, weight percent alumina and weight percent vitrified bonding medium to be employed in said abrasive article's rim;
(b) calculating the coefficient of thermal expansion of said cubic boron nitride, alumina and vitrified bonding medium mixture;
(c) calculating the weight percent silicon carbide, weight percent alumina and weight percent vitrified bonding medium to be employed to form a core material having a coefficient of thermal expansion substantially equal to that of the rim material;
(d) mixing cubic boron nitride, alumina and bonding medium in said predetermined amounts to form a rim mixture;
(e) mixing silicon carbide, alumina and bonding medium in said calculated amounts to form a core mixture;
(f) pressing said core mixture with said rim mixture to form a green article wherein said rim mixture is located on said article's outer surface;
(g) drying said green article at a temperature of about 150° F. for between about 12 to 24 hours; and
(h) heating said article to an elevated temperature for a period of time sufficient to form a vitrified product.

7. The method of forming a vitrified abrasive article of claim 6 wherein said bonding medium is mixed with a binder material to allow said core and rim mixtures to be pressed to form a green article that is resistant to damage prior to firing.

8. The method of forming a vitrified abrasive article of claim 6 wherein said heating step comprises heating the dry green article to a temperature of from between about 1600° F. to 1900° F. for a period of time sufficient to form a vitrified product.

9. The method of forming a vitrified abrasive article of claim 6 wherein said heating step comprises:
heating the dry green article to a temperature of about 900° F. in about 8 hours;
raising said temperature from about 900° F. to about 1750° F. in about 25 hours;

holding said temperature substantially equal to about 1750° F. for about 6 hours;

lowering said temperature from about 1750° F. to about 1400° F. in about 6 hours;

lowering said temperature from about 1400° F. to about 1100° F. in about 10 hours; and lowering said temperature from about 1100° F. to about 100° F. in about 18 hours.

10. A bonding medium compatible with cubic boron nitride, silicon carbide and alumina for use in forming a vitrified grinding article, said medium having an oxide composition comprising:

about 71% by weight silicon dioxide;

about 14% by weight boron oxide;

about 5% by weight aluminum oxide;

about 10% by weight sodium oxide.

11. A pressed green article useful for forming a vitrified grinding article, said green article comprising a core and rim, wherein said core comprises:

(a) from between about 10 to 65% by weight silicon carbide;

(b) from between about 10 to 60% by weight alumina;

(c) from between about 5 to 30% by weight bonding medium;

(d) from between about 1 to 2% by weight binder; and (e) from between about 3 to 5% by weight water; and said rim comprises:

(f) from between about 10 to 70% by weight cubic boron nitride;

(g) from between about 5 and 60% by weight alumina;

(h) from between about 15 to 35% by weight bonding medium;

(i) from between about 1 and 2% by weight binder; and (j) from between about 3 to 5% by weight water.

12. A pressed green article useful for forming a vitrified grinding article, said green article comprising a core and rim, wherein said core comprises:

(a) about 40% by weight silicon carbide;

(b) about 40% by weight alumina;

(c) about 15% by weight bonding medium;

(d) about 2% by weight binder; and (e) about 3% by weight water; and said rim comprises:

(f) about 36% by weight cubic boron nitride;

(g) about 34% by weight alumina;

(h) about 23% by weight bonding medium;

(i) about 2% by weight binder; and (j) about 5% by weight water.

* * * * *